US008517790B2

(12) United States Patent
Rehkemper et al.

(10) Patent No.: US 8,517,790 B2
(45) Date of Patent: Aug. 27, 2013

(54) TRANSFORMING AND SPINNING TOY VEHICLE AND GAME

(75) Inventors: Jeffrey Rehkemper, Chicago, IL (US); Ryan Kratz, Oak Park, IL (US)

(73) Assignee: Rehco, LLC, Chicago, IL (US)

( * ) Notice: Subject to any disclaimer, the term of this patent is extended or adjusted under 35 U.S.C. 154(b) by 376 days.

(21) Appl. No.: 13/034,834

(22) Filed: Feb. 25, 2011

(65) Prior Publication Data

US 2011/0212666 A1 Sep. 1, 2011

Related U.S. Application Data

(60) Provisional application No. 61/307,904, filed on Feb. 25, 2010.

(51) Int. Cl.

| | |
|---|---|
| ***A63H 1/02*** | (2006.01) |
| ***A63H 17/26*** | (2006.01) |
| ***A63H 29/00*** | (2006.01) |
| ***A63H 33/00*** | (2006.01) |
| *A63H 17/00* | (2006.01) |

(52) U.S. Cl.

CPC ..... *A63H 1/02* (2013.01); *A63H 17/008* (2013.01); *A63H 17/266* (2013.01); *A63H 29/00* (2013.01); *A63H 33/003* (2013.01)

USPC ..... 446/259; 446/71; 446/236; 446/237; 446/238; 446/256; 446/264; 446/376; 446/429; 446/465; 446/470

(58) Field of Classification Search

CPC ..... A63H 1/02; A63H 1/006; A63H 17/266; A63H 29/00; A63H 33/003

USPC ..... 446/71, 236, 237, 238, 256, 259, 446/264, 376, 429, 465, 470

See application file for complete search history.

(56) References Cited

U.S. PATENT DOCUMENTS

| | | | | | |
|---|---|---|---|---|---|
| 1,527,205 | A | * | 2/1925 | MacPherson | 446/237 |
| 2,731,765 | A | * | 1/1956 | Carver | 446/409 |
| 3,224,142 | A | * | 12/1965 | Pawelka et al. | 446/138 |
| 3,605,631 | A | * | 9/1971 | See et al. | 46/429 |
| 3,628,285 | A | * | 12/1971 | Murakami | 446/233 |
| 4,087,935 | A | * | 5/1978 | Edmisson et al. | 446/423 |
| 4,156,986 | A | * | 6/1979 | Kupperman et al. | 446/462 |
| 4,192,093 | A | * | 3/1980 | Hamano | 446/427 |
| 4,193,597 | A | * | 3/1980 | Ogawa | 273/405 |
| 4,203,247 | A | * | 5/1980 | Moe et al. | 446/429 |
| 4,463,518 | A | * | 8/1984 | Smathers et al. | 446/237 |
| 4,464,860 | A | * | 8/1984 | Onodera | 446/491 |

(Continued)

*Primary Examiner* — Gene Kim
*Assistant Examiner* — Alexander Niconovich
(74) *Attorney, Agent, or Firm* — Adam K. Sacharoff

(57) ABSTRACT

A transforming vehicle and launch system where the vehicle transforms between multiple configurations including a spinning top. The vehicle includes sliding front and rear segments, two sliding side segments and a receiving cavity. The launch mechanism includes a rotating launch shaft in communication with a power system and a release button. The power system includes the capability to generate and store energy. When the front and rear segments move toward one another, the two side segments are pushed outward directing a central shaft downward below the vehicle. The receiving cavity receives the launch shaft and transfers energy from the power system to the vehicle when it rotates. Energy generated and stored in the power system is transferred to the second configuration via the rotation of the launch shaft when a release button is triggered such that the vehicle separates and spins on the central shaft.

14 Claims, 10 Drawing Sheets

(56) References Cited

U.S. PATENT DOCUMENTS

| | | | | | |
|---|---|---|---|---|---|
| 4,636,177 | A * | 1/1987 | Koguchi | 446/236 |
| 4,737,135 | A * | 4/1988 | Johnson et al. | 446/430 |
| 4,846,758 | A * | 7/1989 | Chou | 446/437 |
| 5,026,057 | A * | 6/1991 | Watford | 273/108.1 |
| 5,310,379 | A * | 5/1994 | Hippely et al. | 446/279 |
| 5,518,437 | A * | 5/1996 | Nonaka et al. | 446/259 |
| 5,542,872 | A * | 8/1996 | Ho | 446/440 |
| 5,667,421 | A * | 9/1997 | Uetake | 446/470 |
| 5,735,727 | A * | 4/1998 | Tsai | 446/462 |
| 5,759,083 | A * | 6/1998 | Polumbaum et al. | 446/435 |
| 5,836,804 | A * | 11/1998 | Tsai | 446/440 |
| 5,860,846 | A * | 1/1999 | Uetake | 446/470 |
| 5,951,363 | A * | 9/1999 | Uetake | 446/470 |
| 6,071,173 | A * | 6/2000 | Kelley | 446/465 |
| 6,089,946 | A * | 7/2000 | Yang | 446/259 |
| 6,394,876 | B1 * | 5/2002 | Ishimoto | 446/428 |
| 6,468,128 | B1 * | 10/2002 | Bala et al. | 446/470 |
| 6,530,817 | B1 * | 3/2003 | Winslow et al. | 446/256 |
| 6,749,482 | B1 * | 6/2004 | Hollis et al. | 446/466 |
| 6,805,609 | B1 * | 10/2004 | Paukert et al. | 446/429 |
| 6,926,581 | B2 * | 8/2005 | Lynders et al. | 446/466 |
| 7,217,170 | B2 * | 5/2007 | Moll et al. | 446/164 |
| 7,740,518 | B2 * | 6/2010 | Elliott | 446/256 |
| 7,794,300 | B2 * | 9/2010 | Moll et al. | 446/164 |
| 7,815,486 | B2 * | 10/2010 | Bernstein et al. | 446/429 |
| 7,950,977 | B2 * | 5/2011 | Sun et al. | 446/435 |
| 7,950,979 | B2 * | 5/2011 | Barthold | 446/470 |
| 8,011,992 | B2 * | 9/2011 | Ejima | 446/93 |
| 8,011,994 | B2 * | 9/2011 | Fink et al. | 446/429 |
| 8,197,298 | B2 * | 6/2012 | Willett | 446/164 |
| 8,210,895 | B2 * | 7/2012 | Bertrand et al. | 446/259 |
| 8,337,271 | B2 * | 12/2012 | Campbell et al. | 446/376 |
| 2009/0075559 | A1 * | 3/2009 | Barthold | 446/470 |
| 2011/0256796 | A1 * | 10/2011 | Ujita et al. | 446/264 |

* cited by examiner 10
20
30
35
40
45
80
90
95
136
140
145
175
200

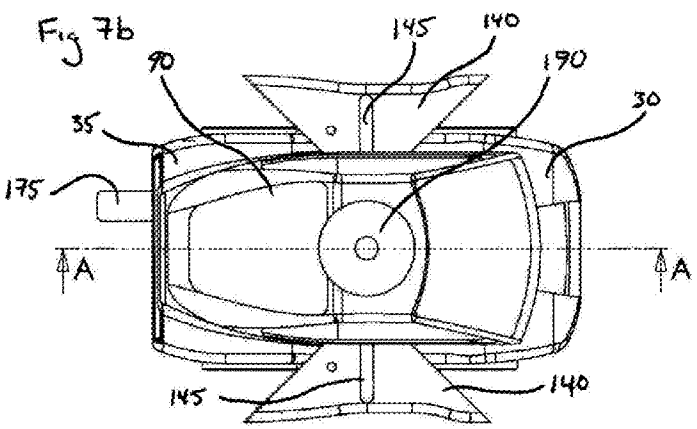
Fig 7b
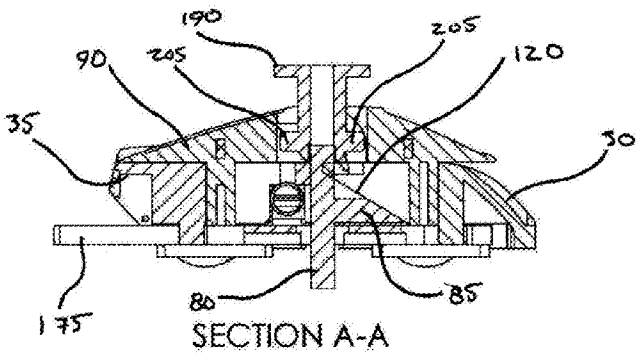
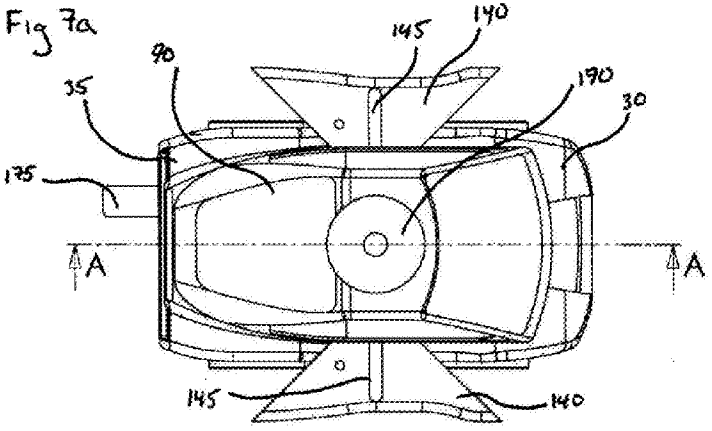
Fig 7a
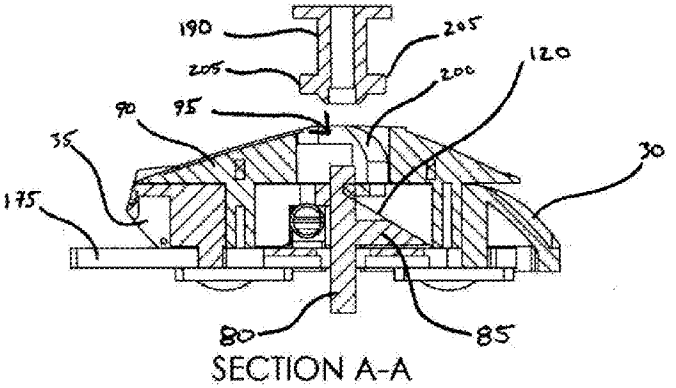

TRANSFORMING AND SPINNING TOY VEHICLE AND GAME

CROSS REFERENCE TO RELATED APPLICATIONS

The present application claims priority to U.S. Provisional Application 61/307,904 filed Feb. 25, 2010.

FIELD OF THE INVENTION

The present invention relates to a transformable toy vehicle, and in particular to a toy vehicle that transforms between multiple configurations, including a spinning top, and utilizes a launch mechanism to spin the vehicle in a top-like manner which can further be incorporated into game play.

BACKGROUND OF THE INVENTION

There have been numerous varieties of children's toys that are non-interactive and interactive. A continual need for improvements in more realistic play qualities along with improved electronics and mechanics provide for new arrangements which improve or change the play and interaction between the child and the toy. Numerous other advantages and features of the invention will become readily apparent from the following detailed description of the invention and the embodiments thereof and from the accompanying drawings.

SUMMARY OF THE INVENTION

In one or more embodiments of the present invention, there is provided a transforming vehicle and launch system. The vehicle includes a sliding front segment, a sliding rear segment, two sliding side segments, a receiving cavity and multiple configurations including a first configuration and a second configuration. The launch mechanism has a rotating launch shaft in communication with a power drive system and a release button. The power drive system includes an energy generation and energy storage means. Further provided is a means to transform the vehicle between the multiple configurations including the first configuration and the second configuration. The front segment and rear segment slide toward one another and push the two side segments outward to direct a central shaft downward to extend below a plane of the vehicle's base housing and locks in position to define the second configuration. The receiving cavity further being shaped to facilitate receipt of the launch shaft and a transfer of energy from the power drive system to the vehicle when the launch shaft rotates. Thereafter, the energy generated and stored in the power drive system is transferred to the second configuration via the rotation of the launch shaft when the release button is triggered such that the vehicle separates from the launch shaft and spins on the central shaft.

BRIEF DESCRIPTION OF THE DRAWINGS

A fuller understanding of the foregoing may be had by reference to the accompanying drawings, wherein:

FIG. 5*a* is a top view of the vehicle from FIG. 2*a* where a portion of an upper housing is removed;

FIG. 7*a* is a sectional view of the vehicle from FIG. 3*a* in a second configuration and a launch shaft illustrating the relationship of a launch shaft and the vehicle prior to insertion of the launch shaft;

FIG. 7*b* is a sectional view of the vehicle from FIG. 3*a* in a second configuration and a launch shaft illustrating the relationship of the launch shaft and the vehicle where the launch shaft is positioned in a cavity of the vehicle;

DESCRIPTION OF THE EMBODIMENTS

Figure 1:
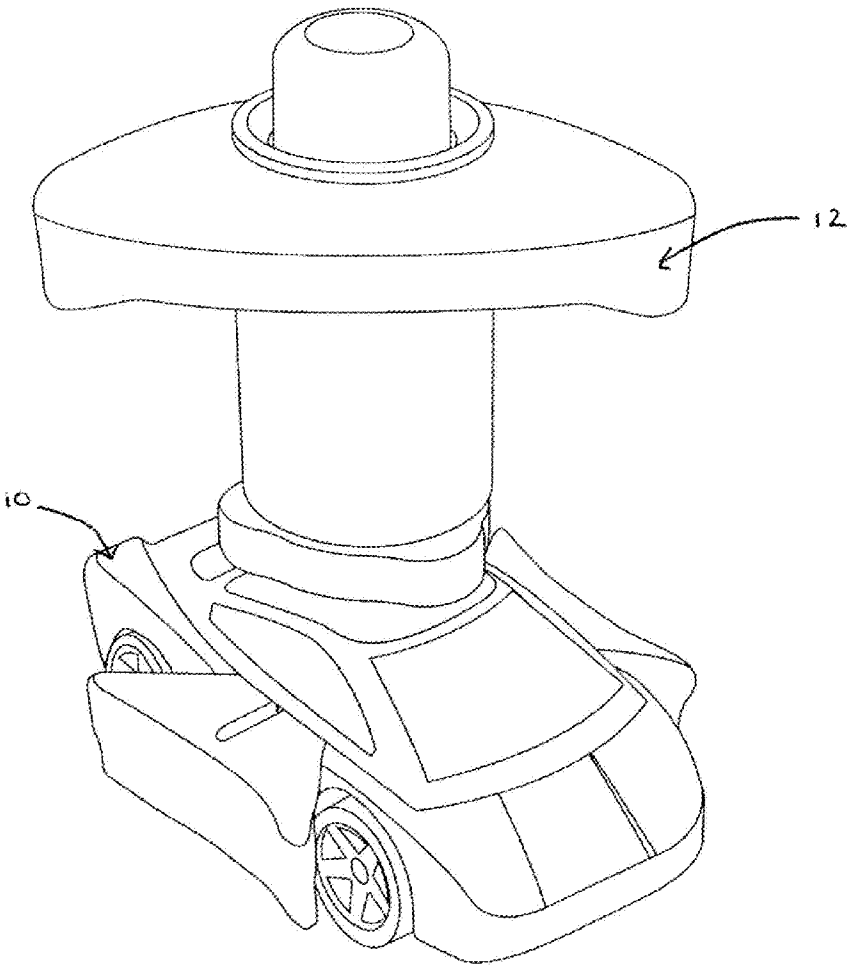
FIG. 1 is a perspective view of a vehicle and a launch mechanism in accordance with an embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention or the embodiments illustrated.

Figure 2B:
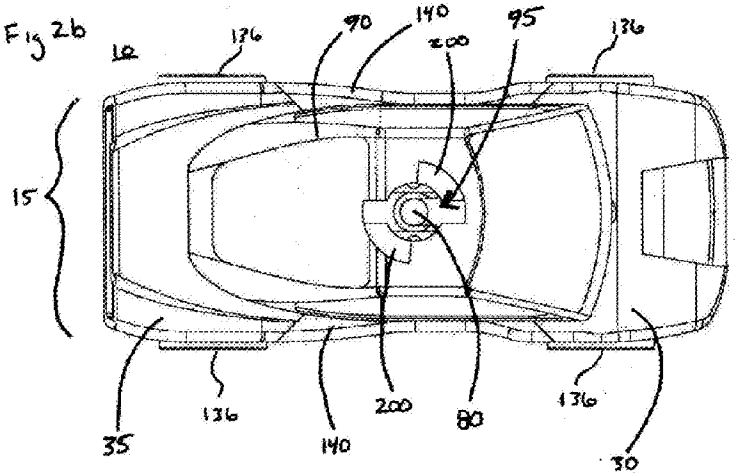
FIG. 2*b* is a top view of FIG. 2*a;*
Figure 2C:
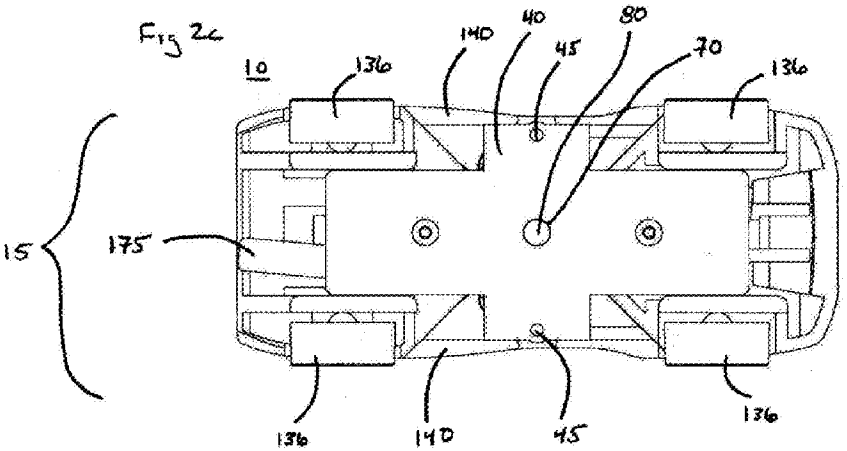
FIG. 2*c* is a bottom view of FIG. 2*a;*
Figure 2A:
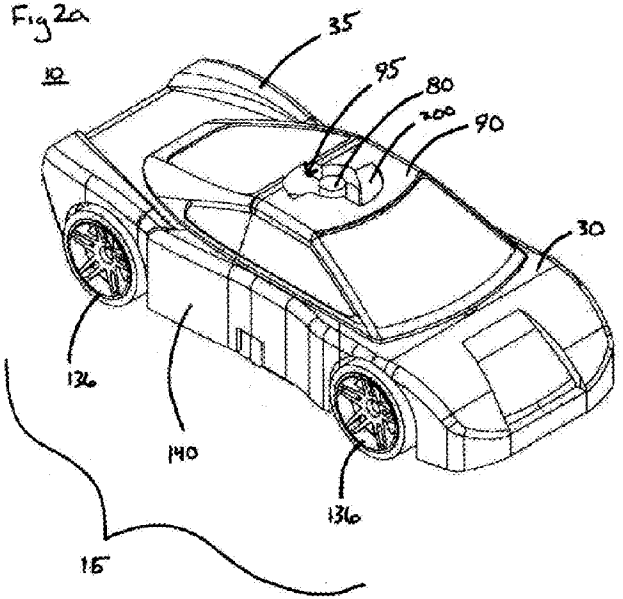
FIG. 2*a* is a perspective view of a first configuration of a vehicle in accordance with an embodiment of the present invention.
Figures 3A, 3B, 3C, 3D:
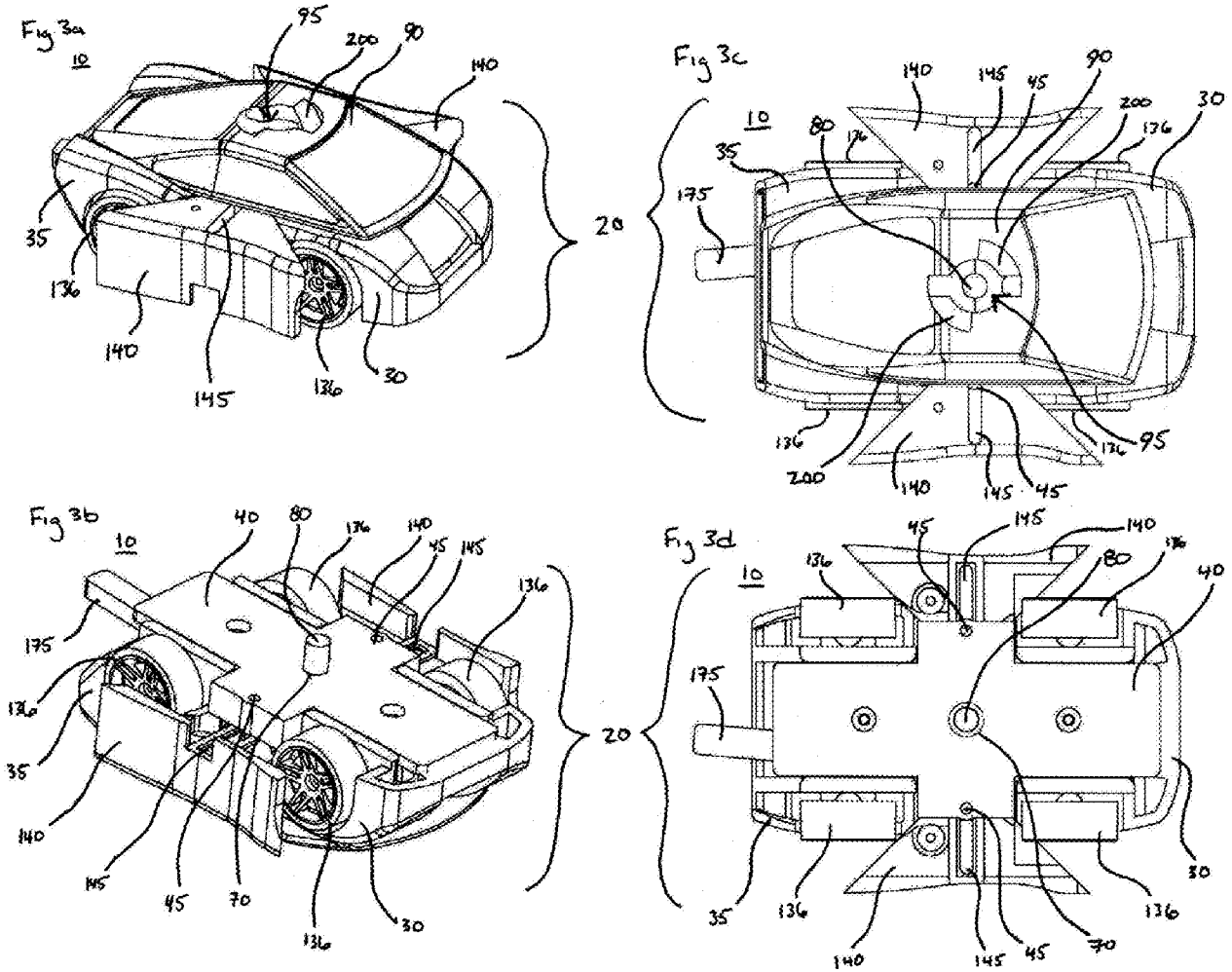
FIG. 3*a* is a perspective view of a second configuration of the vehicle from FIG. 2*a* in accordance with an embodiment of the present invention.
FIG. 3*b* is bottom perspective view of the FIG. 3*a;*
FIG. 3*c* is a top view of FIG. 3*a;*
FIG. 3*d* is a bottom view of FIG. 3*a;*

Referring now to FIG. 1, there is illustrated a transforming vehicle 10 and launch mechanism 12 in accordance with one embodiment of the present invention. The vehicle 10 includes a means to transform between a plurality of configurations including at least a first configuration 15 as shown in FIGS. 2*a*-2*c* to a second configuration 20 as shown in FIGS. 3*a*-3*d*. The second configuration 20 includes spinning top-like characteristics (described below). The launch mechanism 12 includes a means to launch and spin the vehicle 10 in a top-like manner. The vehicle 10 is in the form of a car, however, the vehicle 10 may take on several different forms, such as other types of cars, trucks, planes, animals or other characters. A variety of forms may be used to incorporate the internal mechanics of the vehicle 10 and launch mechanism 12.

Figure 4A:
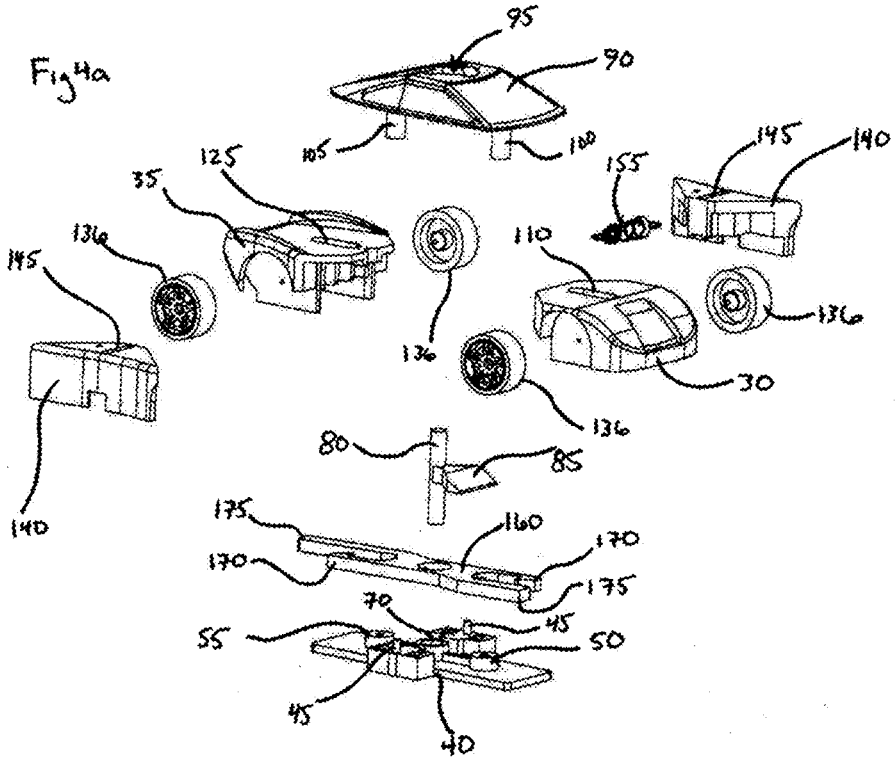
FIG. 4*a* is an exploded perspective view of a vehicle in accordance with an embodiment of the present invention.
Figure 4B:
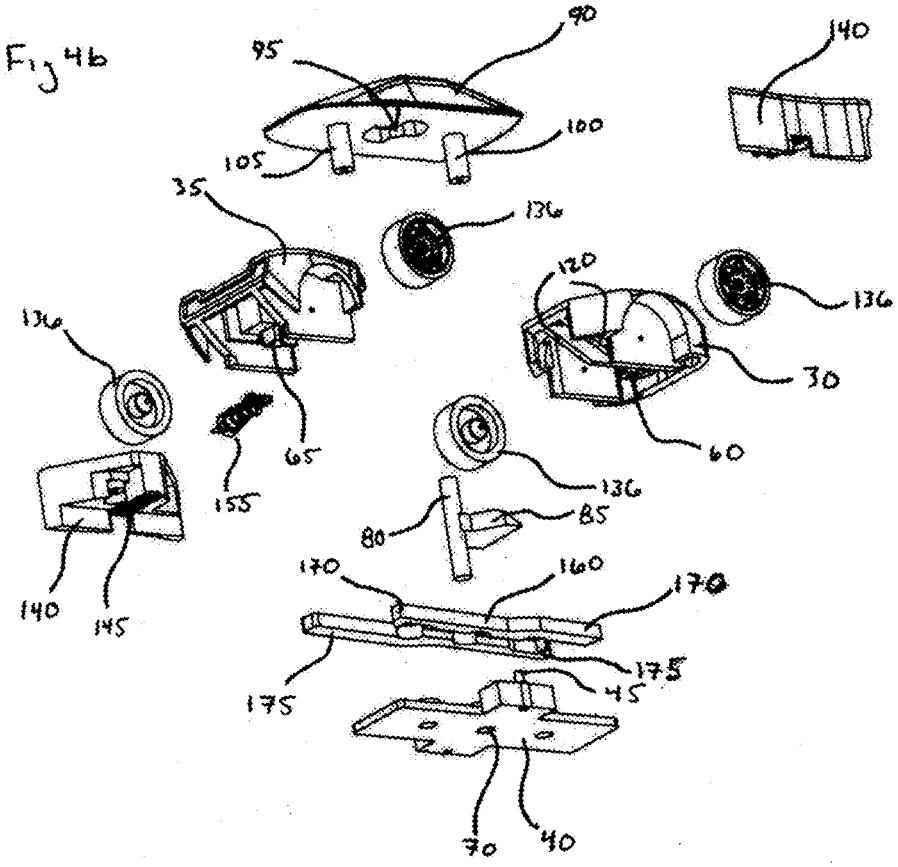
FIG. 4*b* is an bottom perspective view of FIG. 4*a;*

Now additionally referring to FIGS. 4*a* and 4*b*, the internal mechanics of the vehicle 10 are shown. The means to transform the vehicle 10 utilizes a sliding movement of a front segment 30 and a rear segment 35 to direct a transformation action from the first configuration 15 to the second configuration 20 as described below. A base housing 40 includes two side pins 45, a front column 50 and a rear column 55. The front segment 30 includes a front tab 60 and the rear segment 35 includes a rear tab 65. An aperture 70 is positioned on the base housing 40 to receive a shaft 80. The shaft 80 further includes a tapered flange 85 extending therefrom. A spring (not shown) may be positioned on the shaft 80 between the tapered flange 85 and base housing 40 to bias vertical movement of the shaft 80. An upper housing 90 includes a cavity 95, a front pin 100 and a rear pin 105. The front pin 100 and rear pin 105 are fixedly attached to the front column 50 and rear column 55, respectively.

Figure 5B:
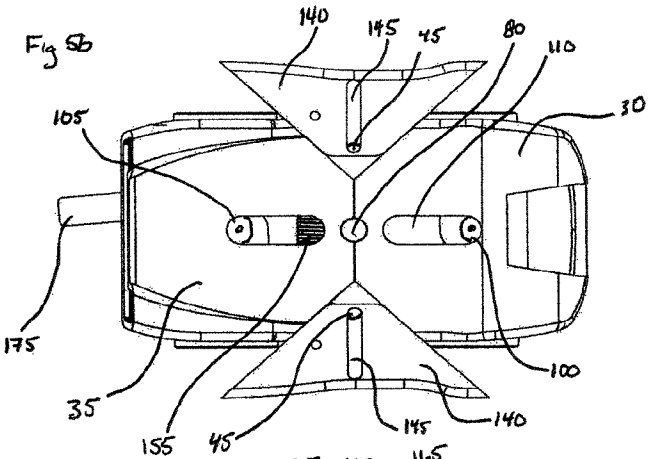
FIG. 5*b* is a top view of the vehicle from FIG. 3*a* where a portion of an upper housing is removed.

Now additionally referring to FIGS. 5*a* and 5*b*, the front segment 30 further includes a front channel 110, tapered edges 120 and the front tab 60. The front pin 100 is positioned in the front channel 110 such that the front channel 110 guides lateral sliding movement of the front segment 30. The rear segment 35 includes a rear channel 125 and the rear tab 65. The rear pin 105 is positioned within the rear channel 125 such that the rear channel 125 guides lateral sliding movement of the rear segment 35. Wheels 136 are rotatably attached to the front segment 30 and the rear segment 35. Sliding the front segment 30 and rear segment 35 toward the shaft 80 directs the transformation action of the vehicle 10 from the first configuration 15 to the second configuration 20 as further described below.

Figure 6B:
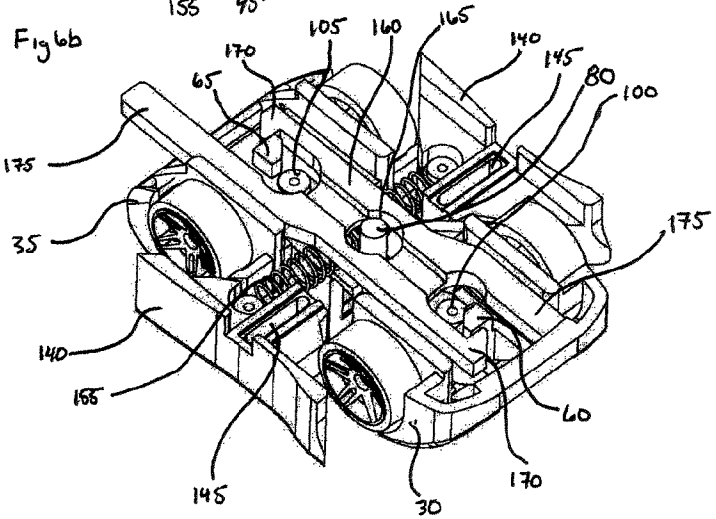
FIG. 6*b* is a bottom perspective view of FIG. 5*b* where a base housing is removed.
Figure 6A:
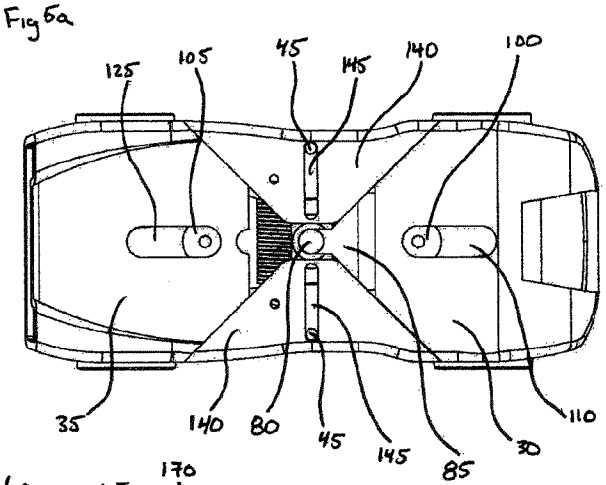
FIG. 6*a* is a bottom perspective view of FIG. 5*a* where a base housing is removed.
Figure 6A:
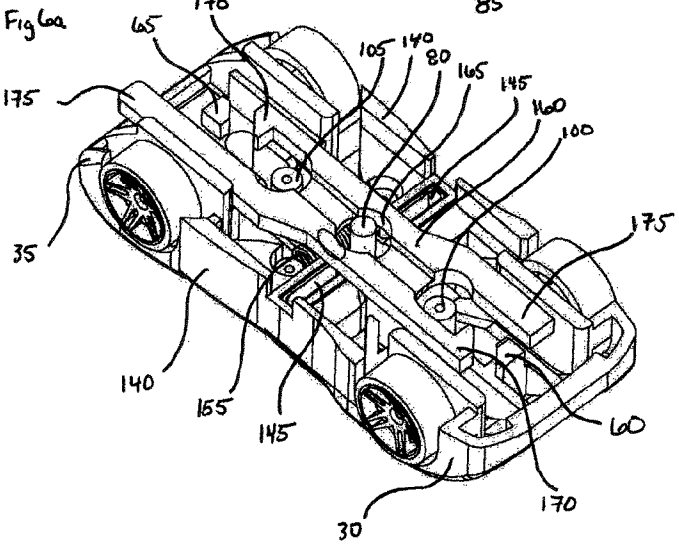

Continuing to refer to FIGS. 5*a*-5*b* and now FIGS. 6*a* and 6*b*, two side segments 140 each include a side channel 145. The side channels 145 receive side pins 45 to guide lateral movement of the side segments 140 in combination with a spring 155 secured to each side segment 140, such that the bias of the spring 155 pulls the side segments 140 toward the shaft 80. A link 160 is positioned between the base housing 40 and the front segment 30 and rear segment 35. The link 160 includes an aperture 165 to accept the shaft 80 and to facilitate pivotal movement of the link 160. The link 160 further includes two hook extensions 170 and at least one trigger extension 175. A link spring (not shown) is secured to one of the hook extensions 170 and the base housing 40. When the front segment 30 and rear segment 35 are pushed toward the shaft 80, the side segments are pushed outward and the link 160 pivots as the link spring extends and the hook extensions 170 contact, slide around and then grip the front tab 60 and rear tab 65 to lock the vehicle 10 in the second configuration 20. Pushing either trigger extension 175 in a direction opposite the bias of link spring releases the hooked extensions 170 from the front tab 60 and the rear tab 65. As the link spring compresses, the link 160 pivots while spring 155 pulls side segments 140 toward the shaft 80 and the front segment 30 and rear segment 35 are pushed, returning the vehicle to the first configuration 15.

Referring now to FIGS. 7*a* and 7*b*, simultaneous to the movement of the front segment 30 and rear segment 35 described above, the tapered flange 85 meets the tapered edges 120 and directs the shaft 80 downward to extend below the plane of the base housing 40 such that the shaft 80 extends below the depth of the wheels 136 so the vehicle 10 may spin on the shaft 80. The cavity 95 is shaped to facilitate insertion of a launch shaft 190 and to facilitate the transfer of energy from the launch mechanism 12 to the vehicle 10. Those in the art will understand that the launch mechanism 12 may accommodate many different power drive systems to generate, store and then release energy. The present invention utilizes the launch shaft 190 to transfer this energy to the vehicle 10 and may function with any number of power drive systems available in the art. The illustrative launch mechanism embodiments described herein are not meant to limit the scope of the present invention.

As the launch shaft 190 is inserted into the cavity 95, tapered paths 200 guide a pair of extensions 205 on the launch shaft 190 into the cavity 95. Energy is generated and stored in a power drive system (not shown) in the launch mechanism 12 prior to positioning the launch shaft 190 in the cavity 95 or while the launch shaft 190 is positioned in the cavity 95. Pressing a release button on the launch mechanism releases the stored energy to rotate the launch shaft 190 and extensions 205, thus rotating the vehicle 10 in accordance thereto. As the extensions 205 rotate, the tapered paths 200 push against the extensions 205 to separate or launch the vehicle 10 to land on a desired surface and spin in a top-like manner.

Figure 8B:
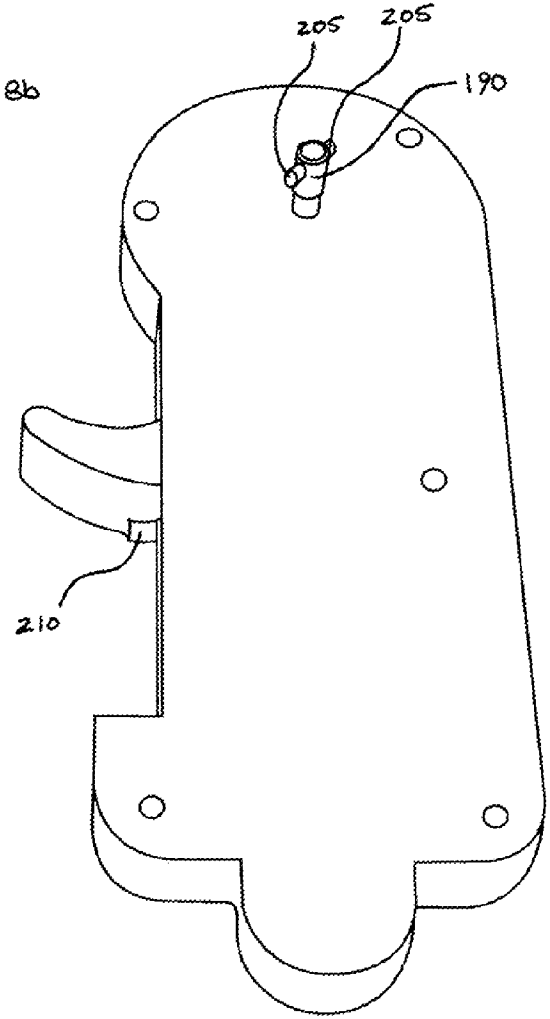
FIG. 8*b* is a perspective view of another example of a launch mechanism in accordance with an embodiment of the present invention.
Figure 8A:
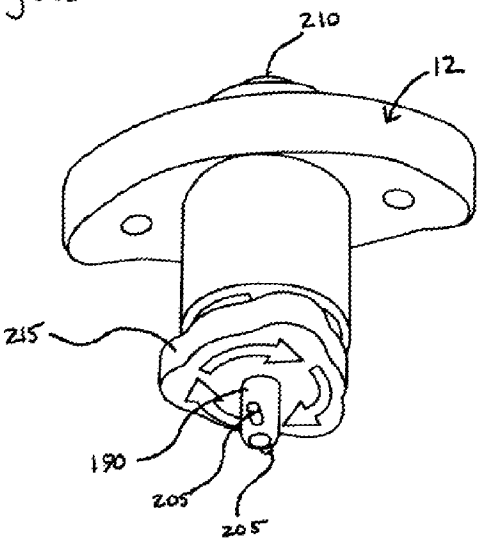
FIG. 8*a* is a perspective view of an example of a launch mechanism in accordance with an embodiment of the present invention.

FIGS. 8*a* and 8*b* show two illustrative embodiments of launch mechanisms. As mentioned above, many different power drive systems may be used in the launch mechanism 12 to rotate the launch shaft 190. For example, the launch shaft 190 may connect to a power drive system, such as a wind up spring or a spring loaded gear drive, and a release button 210. Energy is generated by winding up the spring to a desired power level. Triggering the release button 210 releases the stored energy to rotate the launch shaft 190.

Continuing to refer to FIG. 8*a*, the launch mechanism 12 is shown. In this embodiment, the launch mechanism 12 includes a means to spin the vehicle 10 and a means to adjust the speed at which the vehicle 10 is spun. A housing encloses a power drive system (not shown) to generate and store energy. The drive system is in mechanical communication with the release button 210 and the launch shaft 190 fixed to a rotating cylinder 215. Rotating the cylinder 215 generates energy in the power drive system, the amount of stored energy increasing as the cylinder 215 rotates. The level of stored energy translates to a corresponding level of rotational spin when the vehicle 10 launches. The stored energy may be increased when the launch shaft 190 is engaged with the vehicle 10 or prior to engaging the launch shaft 190 and vehicle 10. Once the desired level of energy is stored, pressing the release button 210 disengages the cylinder 215 while releasing the stored energy in the power drive system, directing the launch shaft 190 to rotate and launch the vehicle 10. As such, the vehicle 10 spins in a top-like manner on the shaft 80.

Figure 9B:
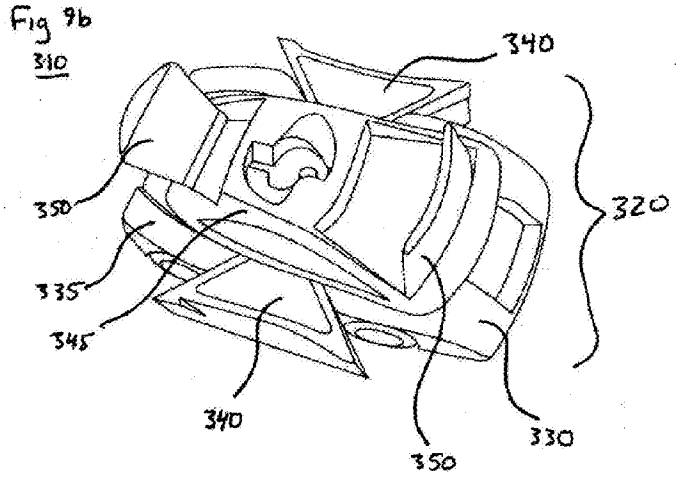
FIG. 9*b* is a perspective view of the vehicle from FIG. 9*a* in a second configuration.
Figure 9A:
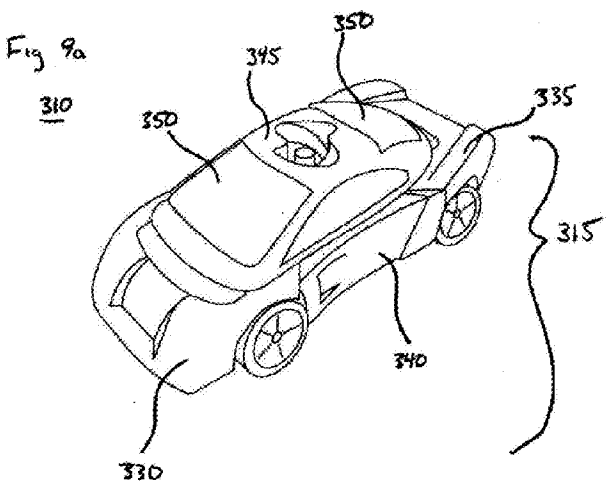
FIG. 9*a* is a perspective view of another embodiment of a vehicle in a first configuration in accordance with the present invention.
Figure 9C:
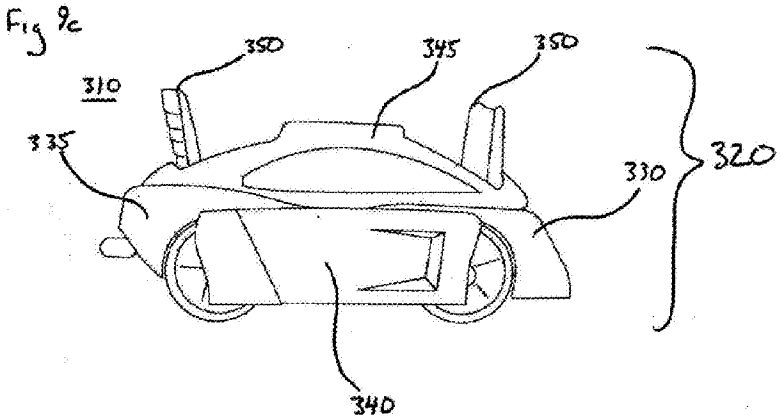
FIG. 9*c* is a side view of FIG. 9*b;*
Figure 10:
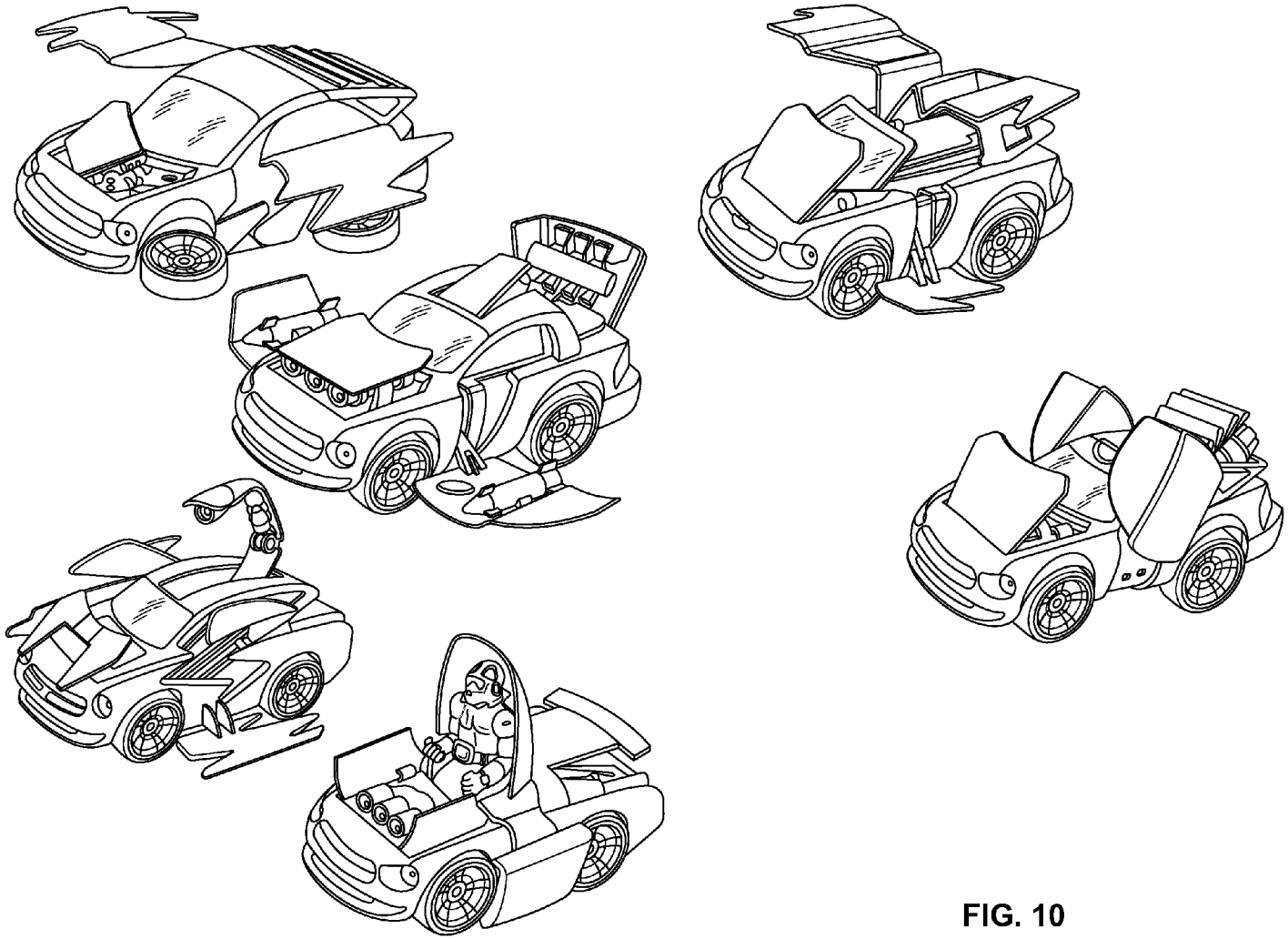
FIG. 10 is a perspective view of examples of addition embodiments of a vehicle in accordance with the present invention.

It should be understood that additional elements or characteristics may also trigger during the transformation action described above. For example, FIGS. 9*a*-9*c* shows another illustrative embodiment of the present invention where a vehicle 310 includes a means to transform between at least a first configuration 315 and a second configuration 320. The vehicle further including a front segment 330, a rear segment 335, two side segments 340 and an upper housing 345 with two windshields 350. In this embodiment, the two wind shields 350 are in mechanical communication with internal mechanics to execute the transformation action (as described above) that direct the two wind shields 350 to deploy when the vehicle 310 transforms from the first configuration 315 to the second configuration 320. FIG. 10 illustrates additional examples of alternative vehicle 10 embodiments.

Figure 11:
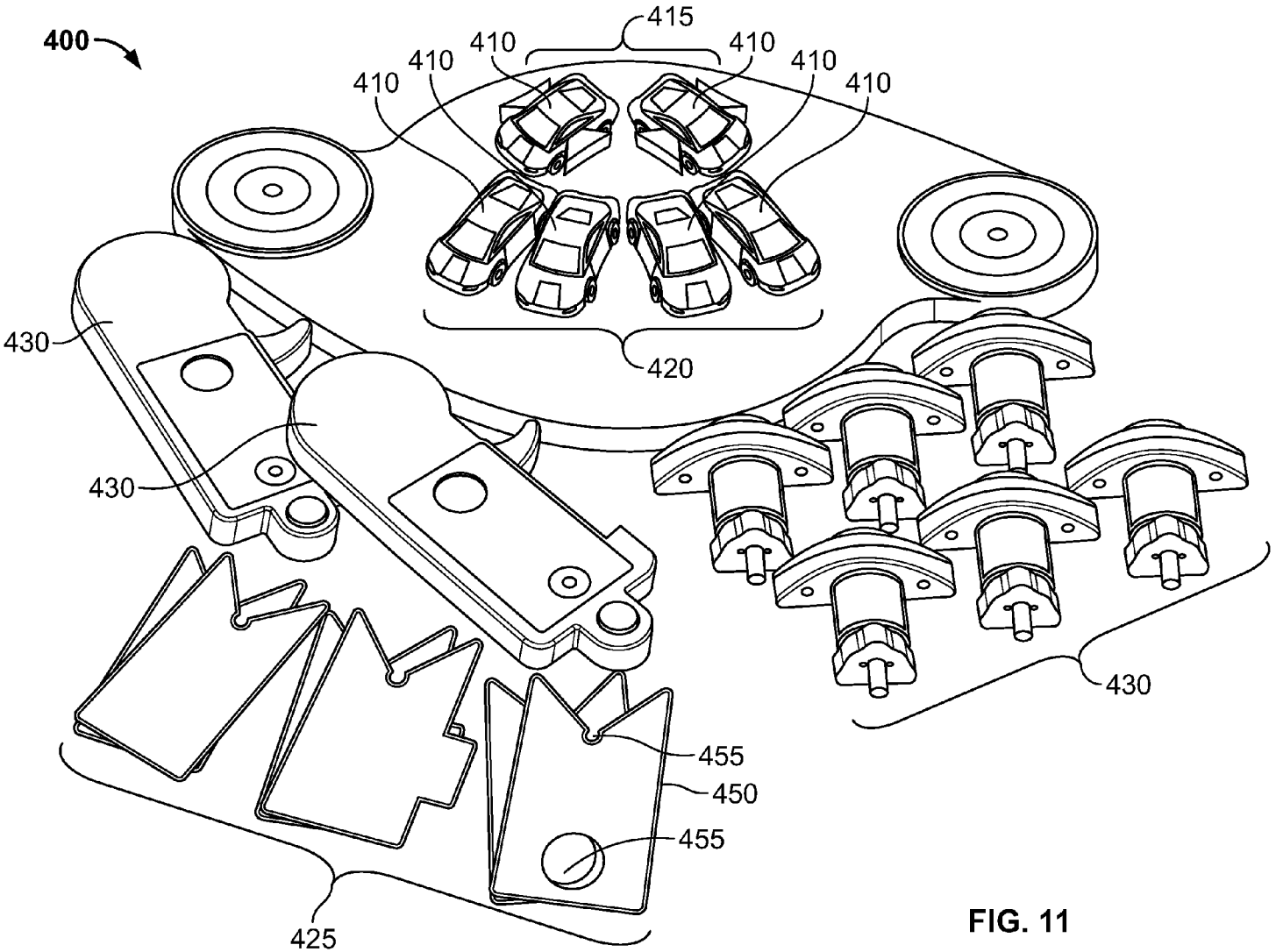
FIG. 11 is an illustrative view of one embodiment of a game in accordance with the present invention.

Referring now to FIG. 11, a game 400 includes a plurality of vehicles 410, each with a cavity, a shaft and the capability to transform between a plurality of configurations, including a first configuration 415 and a second configuration 420 (as described above). Further, the game 400 includes a plurality of directional implements 425 (described below) and a means to incorporate a plurality of launch mechanisms 430, each with a launch shaft and a release button, with game play. Virtually any number of vehicles 410, launch mechanisms 430 and directional implements 425 may be included in game play. Examples of directional implements 425 include cards and dice to prompt player interaction.

In one example of game play for two or more players, the object is for each player to acquire points by winning rounds of "battle" between vehicles. The first player to obtain a predetermined number of points wins. To start play, each player transforms their vehicle 410 from the first configuration 415 to the second configuration 420. Each player then draws a card with directions, such as setting a spin power level or "power up" level. Each player then powers up their respective launch mechanism 430 and inserts the launch shaft in the cavity. The players simultaneously press the release button 440 on the launch mechanisms 430 to spin and launch the vehicles 410 toward one another for a collision or battle. The collision may trigger one or more of the vehicles 410 to transform from the second configuration 420 to the first configuration 415, or one or more of the vehicles 410 will remain in the second configuration 415. Points are awarded accordingly and the players continue to the next round. A directional card 450 may also be included in game play. This directional card 450 is used to direct the movement of the spinning vehicle 410 by positioning the spinning shaft in a cutout 455 of the directional card 450 to control the movement of the spinning vehicle 410. Cards may also include power up directions, which determine the amount of power a player is allowed to store in the launch mechanism 430. Positioning targets or obstacles (not shown) on the playing surface with different point values further adds options for game play, along with accessories to equip vehicles 410 for improved battle capabilities. Examples of accessories include weapons that removeably attach to the vehicles 410. The player that obtains the predetermined point total wins.

There is a virtually unlimited amount of play patterns that can be included in the game play. The example above is meant to be but one of the many and is not meant to limit the invention in any manner.

In the first embodiment, the vehicle 10 includes a means to transform from a first configuration to a second configuration and to launch the vehicle 10 utilizing a launch mechanism with a power drive system.

Further and in accordance with the first embodiment, the vehicle 10 includes a means to transform a vehicle into a top for spinning.

Additionally, the present invention includes a means to transfer energy from a power drive system in a launch mechanism to a vehicle to spin the vehicle in a top-like manner.

An embodiment of the game includes a means to prompt user interaction with the vehicle and launch mechanism.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

The invention claimed is:

1. A transforming vehicle and launch system, the system comprising:

a vehicle with a sliding front segment, a sliding rear segment, two sliding side segments, a receiving cavity and multiple configurations including a first configuration and a second configuration;

a launch mechanism with a rotating launch shaft in communication with a power drive system and a release button, the power drive system including an energy generation and energy storage means;

a means to transform the vehicle between the multiple configurations including the first configuration and the second configuration;

wherein, sliding the front segment and rear segment toward one another pushes the two side segments outward and directs a central shaft downward to extend below a plane of the vehicle's base housing and locks in position to define the second configuration;

the receiving cavity further being shaped to facilitate receipt of the launch shaft and a transfer of energy from the power drive system to the vehicle when the launch shaft rotates; and wherein, energy generated and stored in the power drive system is transferred to the second configuration via the rotation of the launch shaft when the release button is triggered such that the vehicle separates from the launch shaft and spins on the central shaft.

2. The system of claim 1 further comprising:

the front segment further including a front tab, tapered edges and a front channel with a front pin positioned therein such that the front channel guides lateral sliding movement of the front segment;

the rear segment further including a rear tab and rear channel with a rear pin positioned therein such that the rear channel guides lateral sliding movement of the rear segment; and the central shaft including a tapered flange extending therefrom such that when the tapered flange contacts the tapered edges, the tapered edges direct the central shaft downward to extend below the plane of the base housing.

3. The system of claim 2 the vehicle further comprising:

a base housing with two side pins, a front column, a rear column and an aperture to receive the central shaft;

an upper housing including a cavity shaped to receive the launch shaft and to facilitate the transfer of energy from the launch shaft to the vehicle when the launch shaft rotates, the front pin fixed to the front column and the rear pin fixed to the rear column;

two side segments, each side segment including a side channel to receive the respective side pin to guide lateral movement of the side segments; and a link positioned between the lower housing and the front segment and rear segment, the link including two hook extensions and at least one trigger extension, a link spring secured to one of the hook extensions and the base housing, an aperture to accept the central shaft such that the central shaft facilitates pivotal movement of the link.

4. The system of claim 3, wherein as the front segment and rear segment move toward the shaft, the side segments are pushed outward and the link pivots as the link spring extends and the hook extensions move around and then grip the front tab and rear tab with the shaft extending below the base housing to define the second configuration.

5. The system of claim 4, wherein, energy generated and stored in the power drive system is transferred to the second configuration via the rotation of the launch shaft when the release is triggered such that the vehicle separates from the launch shaft and spins on the central shaft.

6. The system of claim 5, the system further comprising:

the link including a trigger extension; and wherein pushing the trigger extension in a direction opposite the bias of the link spring releases the hooked extensions from the front tab and the rear tab, triggering compression of the link spring and directing the link to pivot while the side spring pulls the side segments toward the central shaft and the front segment and rear segment are pushed away from the central shaft such that the vehicle returns to the first configuration.

7. The system of claim 6, the system further comprising:

the front segment including a pair of wheels rotatably attached thereto;

the rear segment including a pair of wheels rotatably attached thereto; and wherein when the tapered flange contacts the tapered edges, the tapered edges direct the central shaft downward to extend below the depth of the wheels.

8. A transforming vehicle and launching system, the system comprising:

a vehicle including a front segment, a rear segment and multiple configurations including a first configuration and a second configuration;

a launch mechanism with a rotating launch shaft in communication with a power drive system and a release button, the power drive system including an energy generation means and energy storage means;

a means to transform the vehicle between the first configuration and second configuration defined by the utilization of a sliding movement of the front segment and rear segment in combination with a central shaft to direct transformation from the first configuration to the second configuration;

the front segment further including a front tab, tapered edges and a front channel with a front pin positioned therein such that the front channel guides lateral sliding movement of the front segment;

the rear segment further including a rear tab and rear channel with a rear pin positioned therein such that the rear channel guides lateral sliding movement of the rear segment;

the central shaft including a tapered flange extending therefrom such that when the tapered flange contacts the tapered edges, the tapered edges direct the shaft downward to extend below the plane of the base housing;

the vehicle further including:

a base housing with two side pins, a front column, a rear column and an aperture to receive the central shaft;

an upper housing including a cavity shaped to receive the launch shaft and to facilitate the transfer of energy from the launch shaft to the vehicle when the launch shaft rotates, the front pin fixed to the front column and the rear pin fixed to the rear column;

two side segments, each side segment including a side channel to receive the respective side pin to guide lateral movement of the side segments;

a link positioned between the lower housing and the front segment and rear segment, the link including two hook extensions and at least one trigger extension, a link spring secured to one of the hook extensions and the base housing, an aperture to accept the central shaft such that the central shaft facilitates pivotal movement of the link;

wherein, as the front segment and rear segment move toward the shaft, the side segments are pushed outward and the link pivots as the link spring extends and the hook extensions move around and then grip the front tab and rear tab with the shaft extending below the base housing to define the second configuration; and wherein, energy generated and stored in the power drive system is transferred to the second configuration via the rotation of the launch shaft when the release is triggered such that the vehicle separates from the launch shaft and spins on the central shaft.

9. The system of claim 8 further comprising:

the link including a trigger extension; and wherein pushing the trigger extension in a direction opposite the bias of the link spring releases the hooked extensions from the front tab and the rear tab, triggering compression of the link spring and directing the link to pivot while the side spring pulls the side segments toward the central shaft and the front segment and rear segment are pushed away from the central shaft such that the vehicle returns to the first configuration.

10. The system of claim 9 further comprising:

the front segment including a pair of wheels rotatably attached thereto;

the rear segment including a pair of wheels rotatably attached thereto; and wherein when the tapered flange contacts the tapered edges, the tapered edges direct the central shaft downward to extend below the depth of the wheels.

11. The system of claim 8, the launch mechanism further comprising:

a means to adjust the speed at which the launch shaft spins and therefore the speed at which the vehicle spins.

12. The system of claim 11 further comprising:

vehicle elements that deploy when the front segment and rear segment move toward the central shaft to define at least a third configuration.

13. The system of claim 11 wherein the vehicle elements are doors.

14. The system of claim 13 wherein the vehicle elements are a front and rear windshield.

* * * * *